US006794950B2

(12) United States Patent
du Toit et al.

(10) Patent No.: US 6,794,950 B2
(45) Date of Patent: Sep. 21, 2004

(54) WAVEGUIDE TO MICROSTRIP TRANSITION

(75) Inventors: Cornelis Frederik du Toit, Ellicott City, MD (US); Mangipudi Ramesh, Petaling Jaya (MY)

(73) Assignee: Paratek Microwave, Inc., Columbia, MD (US)

( * ) Notice: Subject to any disclaimer, the term of this patent is extended or adjusted under 35 U.S.C. 154(b) by 18 days.

(21) Appl. No.: 10/025,311

(22) Filed: Dec. 19, 2001

(65) Prior Publication Data

US 2002/0097109 A1 Jul. 25, 2002

Related U.S. Application Data

(60) Provisional application No. 60/257,312, filed on Dec. 21, 2000.

(51) Int. Cl.[7] ..... H01P 1/16
(52) U.S. Cl. ..... 333/21 R; 333/26; 333/34
(58) Field of Search ..... 333/21 R, 34, 333/26

(56) References Cited

U.S. PATENT DOCUMENTS

| | | | | |
|---|---|---|---|---|
| 2,772,400 A | * | 11/1956 | Simmona | 333/21 R |
| 3,396,350 A | * | 8/1968 | Krank et al. | 333/241 |
| 3,852,689 A | * | 12/1974 | Watson | 333/113 |
| 4,453,142 A | | 6/1984 | Murphy | |
| 4,562,416 A | | 12/1985 | Sedivec | |
| 4,651,115 A | | 3/1987 | Wu | |
| 4,754,239 A | | 6/1988 | Sedivec | |
| 4,973,925 A | | 11/1990 | Nusair et al. | |
| 4,978,934 A | * | 12/1990 | Saad | 333/241 |
| 5,095,292 A | | 3/1992 | Masterton | |
| 5,278,575 A | | 1/1994 | Thomas | |
| 5,414,394 A | | 5/1995 | Gamand et al. | |
| 5,539,361 A | | 7/1996 | Davidovitz | |
| 5,600,286 A | | 2/1997 | Livingston et al. | |
| 5,793,263 A | | 8/1998 | Pozar | |
| 5,912,598 A | | 6/1999 | Stones et al. | |
| 6,002,305 A | | 12/1999 | Sanford et al. | |
| 6,081,241 A | | 6/2000 | Josefsson et al. | |
| 6,097,264 A | * | 8/2000 | Vezmar | 333/21 A |
| 6,127,901 A | | 10/2000 | Lynch | |
| 6,144,266 A | | 11/2000 | Heidemann et al. | |
| 6,265,950 B1 | | 7/2001 | Schmidt et al. | |
| 6,268,781 B1 | | 7/2001 | Schaffner | |
| 6,522,215 B2 | * | 2/2003 | Enokuma | 333/21 A |

FOREIGN PATENT DOCUMENTS

DE 4441073 C 1/1996

OTHER PUBLICATIONS

R. Knerr, "A New Type of Waveguide–to–Stripline Transition," *IEEE Trans. Microwave Theory and Tech.* (Corresp.), vol. MTT–16, Mar. 1968, pp. 192–194.

B. Glance et al, "A Waveguide to Suspended Stripline Transition," *IEEE Trans. Microwave Theory and Tech.* (Lett.), vol. MTT–21, Feb. 1973, pp. 117–118.

(List continued on next page.)

*Primary Examiner*—Robert Pascal
*Assistant Examiner*—Kimberly Glenn
(74) *Attorney, Agent, or Firm*—Robert P. Lenart; James S. Finn

(57) ABSTRACT

A waveguide to microstrip T-junction includes a microstrip transmission line structure having a ground plane separated from a strip conductor by a dielectric layer, the ground plane defining an aperture; a waveguide channel having a conductive periphery being electrically coupled to the ground plane to provide a waveguide short circuit wall located at the end of the waveguide channel; at least one conducting ridge inside the waveguide channel; and an end of the ridge being electrically coupled with the ground plane.

6 Claims, 7 Drawing Sheets

OTHER PUBLICATIONS

J. Van Heuven, "A New Integrated Waveguide–Microstrip Transition," *IEEE Trans. Microwave Theory and Tech.*, vol. MTT–24, Mar. 1976, pp. 144–147.

L. Lavedan, "Design of Waveguide–to–Microstrip Transitions Specially Suited to Millimetre–Wave Applications," *Electronics Letters*, vol. 13, No. 20, Sep. 1977.

J. Rao et al., "Analysis of Small Aperture Coupling Between Rectangular Waveguide and Microstrip Line," *IEEE Trans. Microwave Theory and Tech.*, vol. MTT–29, No. 2, Feb. 1981, pp. 150–154.

S. Moochalla, "Ridge Waveguide Used in Microstrip Transition," *Microwaves & RF*, Mar. 1984, pp. 149–152.

P. Pramanick et al., "Analysis and Synthesis of Tapered Fin–Lines," *IEEE MTT–S Digest*, 1984, pp. 336–338.

B. Das et al., "Excitation of Waveguide by Stripline– and Microstrip–Line–Fed Slots," *IEEE Trans. Microwave Theory and Tech.*, vol. MTT–34, Mar. 1986, pp. 321–327.

G. Ponchak et al., "A New Model for Broadband Waveguide–to–Microstrip Transition Design," *Microwave Journal*, May 1988, pp. 333–343.

Y.C. Shih et al, "Waveguide–to–Microstrip Transitions for Millimeter–Wave Applications," *IEEE MTT–S Int'l Symposium Digest*,New York, NY, vol. 1, 1988, pp. 473–475.

T. Ho et al, "Spectral–Domain Analysis of E–Plane Waveguide to Microstrip Transitions," *IEEE Trans. Microwave Theory and Tech.*, vol. 37, No. 2, Feb. 1989, pp. 388–392.

W. Grabherr et al, "Microstrip to Waveguide Transition Compatible With MM–Wave Integrated Circuits," *IEEE Trans. Microwave Theory and Tech.* (Short Papers), vol. 42, No. 9, Sep. 1994, pp. 1842–1843.

L. Hyvönen et al, "A Compact MMIC–Compatible Microstrip to Waveguide Transition," *IEEE MTT–S Int'l Symposium Digest*, San Francisco, CA, vol. 2, 1996, pp. 875–878.

A. Omar et al, "Analysis of Slot–Coupled Transitions From Microstrip–to–Microstrip and Microstrip–to–Waveguides," *IEEE Trans. Microwave Theory and Tech.* (Short Papers), vol. 45, No. 7, Jul. 1997, pp. 1127–1132.

N. Kaneda et al, "A Broad–Band Microstrip–to–Waveguide Transition Using Quasi–Yagi Antenna," *IEEE Trans. Microwave Theory and Tech.*, vol. 47, No. 12, Dec. 1999, pp. 2562–2567.

L. Hildebrand et al, "Full–Wave Analysis of a New Microstrip–to–Waveguide Interconnect Configuration," *IEEE Trans. Microwave Theory and Tech.*, vol. 48, No. 1, Jan. 2000, pp. 1–7.

Soviet Patent Abstracts, SU 1739411 A1, Derwent Publications Ltd., XP–002195926, Jul. 7, 1993.

M. Davidovitz, "Wide–Band Waveguide–to–Microstrip Transition and Power Divider," *IEEE Microwave and Guided Wave Letters*, vol. 6, No. 1, 1996, pp. 13–15.

* cited by examiner

WAVEGUIDE TO MICROSTRIP TRANSITION

CROSS REFERENCE TO A RELATED APPLICATION

This application claims the benefit of U.S. Provisional Application Ser. No. 60/257,312, filed Dec. 21, 2000.

BACKGROUND OF THE INVENTION

This invention relates to microwave components and more particularly to waveguide to microstrip coupling structures.

Waveguide to microstrip transitions are used in a variety of applications, such as in low loss antenna feed structures, high Q microwave filters and duplexers, high power combining devices, etc. This type of guided wave transition combines the low loss properties of the waveguide, with the flexibility of microstrip circuits. The topology is governed by the particular application at hand. As a result, numerous designs have been reported in the literature.

Some configurations are based on a monopole probe, whereby part of the microstrip or stripline circuit board protrudes through an opening in the broad wall of the waveguide to support the monopole appropriately. Other configurations require the microstrip circuit to be in the E-plane of the waveguide. Improvements have been made to address resonance problems and offer more general design guidelines. One design uses an electrically small microstrip radiating element in the E-plane of the waveguide, such as a quasi-Yagi antenna. These microstrip structures are mounted inside the waveguide.

Other transitions are based on aperture coupling between the microstrip and waveguide. This type of transition has the advantage that it eliminates the need for specially shaped printed circuit boards inside the waveguide, and it is very tolerant to small errors in the position of the aperture with respect to the waveguide. Some problems associated with this approach are that the aperture introduces additional radiation loss, and that it tends to have a limited bandwidth. Analysis of small aperture coupling between the end-wall of a rectangular waveguide and microstrip shows that such coupling is very small, due to a severe wave impedance mismatch between the waveguide and the microstrip loaded aperture. A larger, resonant aperture together with short-circuited microstrip stub matching yields better coupling. However, impedance matching is achieved only over a very narrow bandwidth and the high Q resonant microstrip stub adds to radiation and conduction losses. Matching structures inside the waveguide such as an E-plane waveguide fin also offer a lower loss but relatively narrow band solution. The introduction of a patch resonator and an additional dielectric quarter wave transformer inside the waveguide greatly increases the bandwidth, but this adds to the complexity and also introduces additional loss.

Aperture coupled transitions do not require the support of a specially shaped printed circuit board inside the waveguide, and the performance may be relatively insensitive to the position of the aperture in the waveguide. Early attempts with simple rectangular apertures did not produce coupling levels of practical significance. Some improvements, such as the addition of a short-circuited microstrip stub or an E-plane waveguide fin yield better coupling, but only over a narrow bandwidth. Another problem is that a resonant microstrip stub introduces extra losses, and the electrically large rectangular aperture tends to produces more radiation loss.

U.S. Pat. No. 6,127,901 discloses a transition having a slot in the broad wall near the short-circuited end of a rectangular waveguide, including a tapering narrow dimension for matching to a microstrip over a wide frequency band via an aperture coupled arrangement with an open circuited microstrip stub.

There exists a need for a waveguide to microstrip transition that provides an improved matching structure, has wide band coupling, and uses a relatively small aperture to reduce losses.

SUMMARY OF THE INVENTION

A waveguide to microstrip T-junction includes a microstrip transmission line structure having a ground plane separated from a strip conductor by a dielectric layer, the ground plane defining an aperture; a waveguide channel having a conductive periphery being electrically coupled to the ground plane to provide a waveguide short circuit wall located at the end of the waveguide channel; at least one conducting ridge inside the waveguide channel; and an end of the ridge being electrically coupled with the ground plane.

DESCRIPTION OF THE INVENTION

Figure 1:
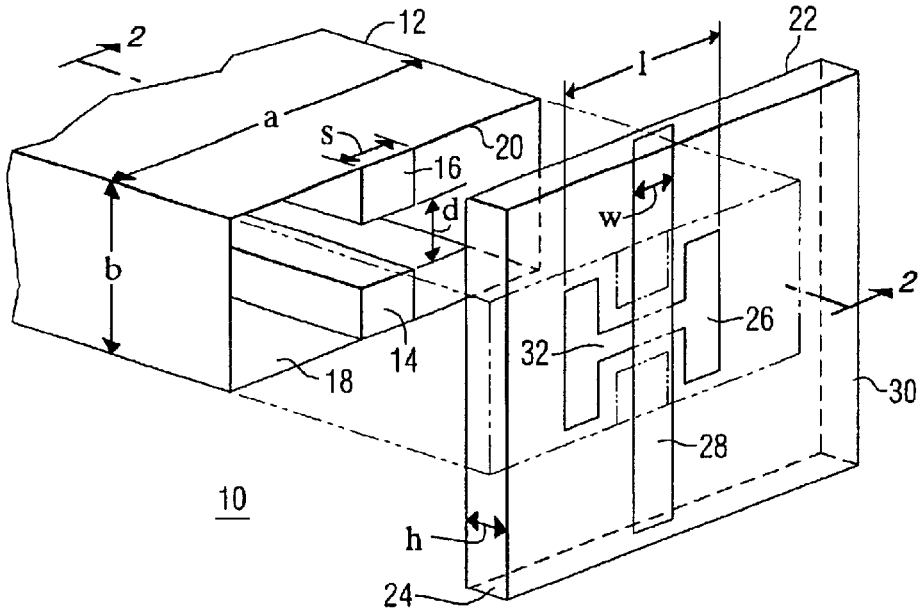
FIG. 1 is an exploded isometric view of a waveguide to microstrip transition constructed in accordance with one embodiment of the invention.

Referring to the drawings, FIG. 1 is an exploded isometric view of a waveguide to microstrip transition 10 constructed in accordance with one embodiment of the invention. The transition includes a rectangular waveguide 12 and a pair of ridges 14, 16 extending into the waveguide and positioned along opposite interior surfaces 18, 20. An end wall 22 on a surface of a substrate 24 is positioned at an end of the waveguide. The end wall defines an H-shaped aperture 26. A microstrip 28 is positioned on a surface 30 of the substrate opposite the waveguide. The microstrip lies across a center portion 32 of the H-shaped aperture.

In the power splitter mode of operation, the rectangular waveguide 12 is excited by a transverse electric electromagnetic wave, which propagates towards the end-wall 22. When it impinges on the transition discontinuity from the ridgeless portion of the waveguide to the ridged portion of the waveguide, a first reflection of the wave is created. The wave propagates further along the ridged waveguide portion, with the electromagnetic energy concentrated substantially in the gap between the ridges, until it reaches the end-wall 22, where a second reflection is caused by the end-wall 22 discontinuity. Electric currents are induced in the end-wall 22, which are disrupted by the aperture 26, causing a potential difference across the aperture 26. This creates an electric field which in turn induces currents in the strip conductor 28, thereby exciting two electromagnetic waves guided by the strip conductor 28 away from the aperture 26, while the end-wall 22 acts as a ground plane for the strip conductor 28.

The second reflected wave reflects back and forth between the discontinuities, forming a resonance from which some energy leaks away to launch a first interfering wave back into the ridgeless portion of the waveguide and a second interfering wave through the aperture to the strip conductor 28. Under matching conditions, the first interfering wave cancels the first reflected wave. In terms of the waves launched onto the strip conductor 28 through the aperture, the latter appears as a source (with a source resistance twice that of the characteristic impedance of the strip) connected in series with two strip transmission lines.

A ridged waveguide can be used to guide the electromagnetic energy to an electrically small aperture in the end-wall of the waveguide using only low Q resonant matching sections, thereby improving bandwidth and lowering conduction loss. This property has been used to couple directly from a ridged waveguide to a microstrip circuit aligned with the H-plane of the waveguide.

The device is a three port device, the first port being a waveguide port, and the other ports being the strip transmission line. It includes a waveguide, one or two conducting ridges, a conducting ground plane (preferably copper) with an aperture, and a dielectric substrate (preferably a pcb material such as manufactured by Rogers, Metclad, Taconic etc.), supporting a conducting metal strip (preferably copper). The waveguide and conducting ridges can be machined in two halves using bulk copper, aluminum or brass or any other appropriate metal or alloy, which can be silver-plated or gold plated to enhance conductivity or increase resistance against corrosion.

The waveguide is a cylindrical hole of arbitrary cross-section, preferably rectangular or elliptical, in a conducting medium or a medium with a surface rendered conductive. The cylindrical conducting boundary of the waveguide will be referred to as the waveguide periphery. The ridge or ridges are elongated conductors, preferably but not necessarily of rectangular cross-section, placed along the center line of one or both of the broad walls inside the waveguide. The ground plane of the strip conductor forms the waveguide end-wall. The ridges preferably are in electrical contact with the waveguide periphery (in opposition to each other if there are two ridges) and the end-wall. A single ridge creates a narrow gap between itself and the opposite side of the waveguide periphery. Alternatively two ridges form a narrow gap between each other. The strip is external to the waveguide and crosses over the aperture in the end-wall/ground plane. The two ends of the strip form the two strip transmission line ports on either side of the aperture crossing.

The device can be regarded as a T-junction, therefore the modes of operation are as a power splitter and as a power combiner. These two modes are reciprocal, therefore it will suffice to explain the operation of the device as a power splitter. In this case, the electromagnetic wave is launched into the waveguide port, which acts as the input port. The ridges inside the waveguide are used to ensure wave impedance matching to the aperture in the end-wall. The electromagnetic wave couples by induction through the aperture to the strip, where it bifurcates and propagates away from the aperture along the strip conductor in opposite directions, but with opposite phase. As such, the aperture in the strip ground plane acts as a microwave source connected in series with two strip transmission line branches.

Figure 2:
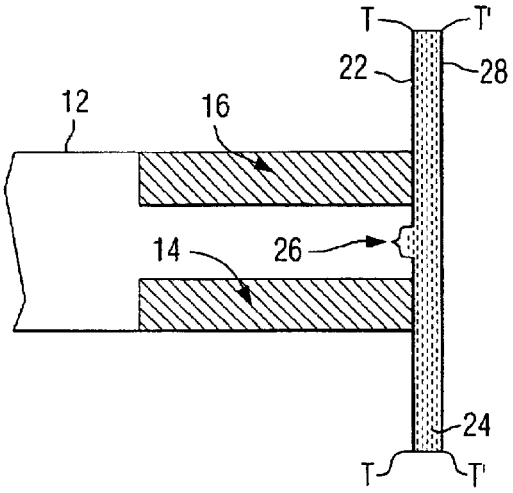
FIG. 2 is cross sectional view of the waveguide to microstrip transition of FIG. 1 taken along line 2—2.
Figure 3:
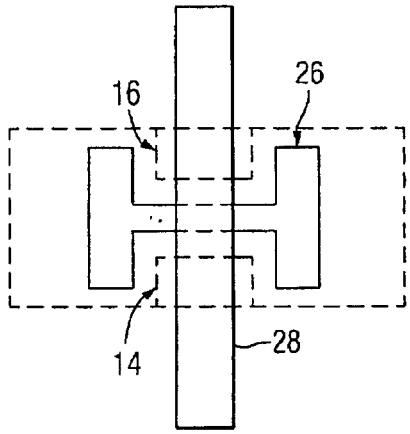
FIG. 3 is an end view of the waveguide to microstrip transition of FIG. 1.

FIG. 2 is cross sectional view of the waveguide to microstrip transition of FIG. 1 taken along line 2—2. FIG. 3 is and end view of the waveguide to microstrip transition of FIG. 1.

Figure 4:
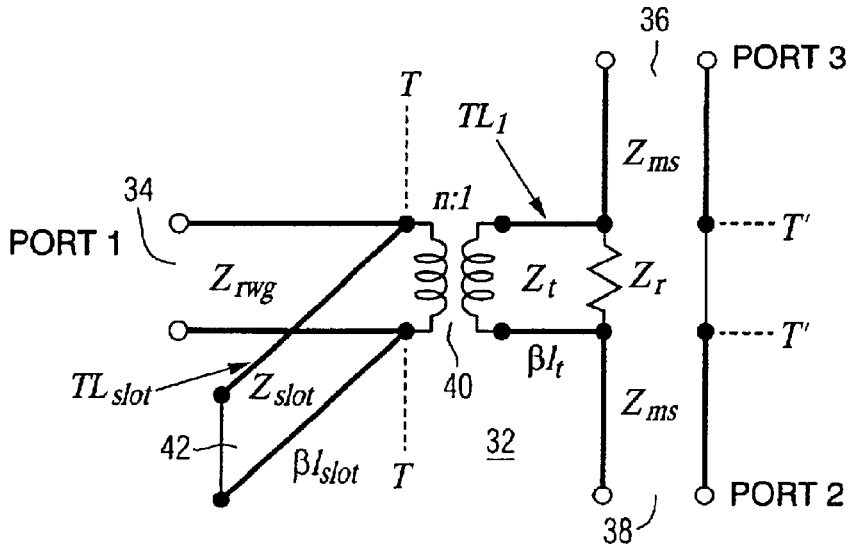
FIG. 4 is schematic diagram of an equivalent circuit for the waveguide to microstrip transition of FIG. 1.

FIG. 4 is schematic diagram of an equivalent circuit 32 for the waveguide to microstrip transition of FIG. 1. The circuit shows three ports 34, 36 and 38, with port 34 being the waveguide port, and ports 36 and 38 being at opposite ends of the strip conductor. Transformer 40 represents the coupling between the waveguide and the strip conductor. A shorted stub 44 represents the slot.

As a further refinement, the ridge heights and/or widths can be stepped or smoothly shaped to provide impedance matching over an arbitrary wide frequency bandwidth.

Figure 5:
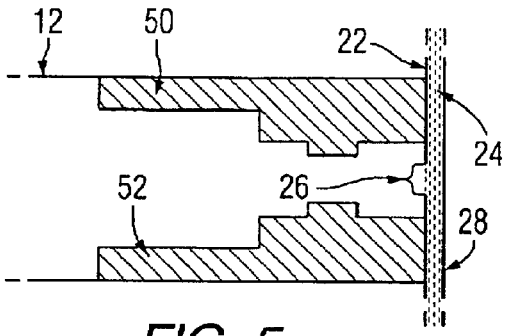
FIG. 5 is cross sectional view of another embodiment of a waveguide to microstrip transition constructed in accordance with the invention.

FIGS. 5–8 illustrate alternative embodiments of the ridge matching section of the waveguide. FIG. 5 is an E-plane cross sectional view of a waveguide to microstrip transition showing stepped variations in the height of the ridges 50 and 52.

Figure 6:
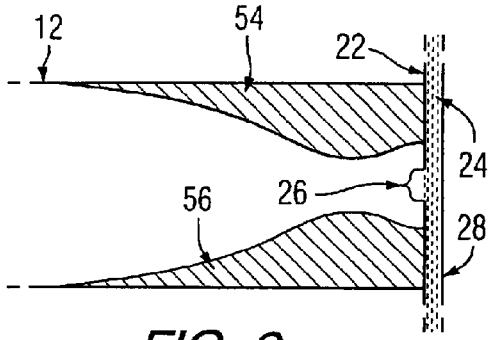
FIG. 6 is cross sectional view of another embodiment of a waveguide to microstrip transition constructed in accordance with the invention.

FIG. 6 is an E-plane cross sectional view of another embodiment of a waveguide to microstrip transition showing smooth variations in the height of the ridges 54 and 56.

Figure 7:
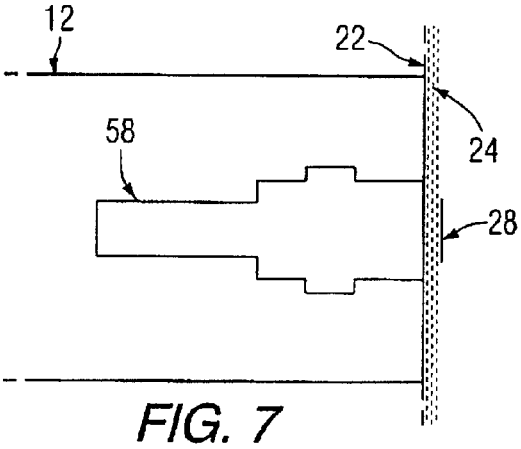
FIG. 7 is cross sectional view of another embodiment of a waveguide to microstrip transition constructed in accordance with the invention.

FIG. 7 is an H-plane cross sectional view of another embodiment of a waveguide to microstrip transition showing stepped variation in the width of the ridge 58.

Figure 8:
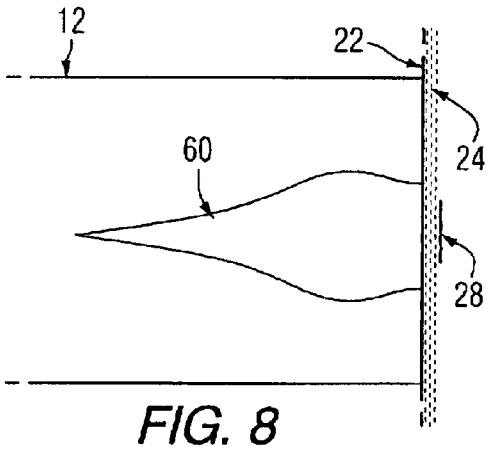
FIG. 8 is cross sectional view of another embodiment of a waveguide to microstrip transition constructed in accordance with the invention.

FIG. 8 is an H-plane cross sectional view of another embodiment of a waveguide to microstrip transition showing smooth variation in the width of the ridge 60. The more complex variation of the ridge dimensions along its length causes a multitude of reflections, which can be optimized to minimize the total reflection over an arbitrary frequency bandwidth.

As a variation on the basic preferred embodiments, the strip conductor geometry can be changed to create an unequal and/or asymmetric power divider/combiner. This is done by dissimilarly stepped or smoothly tapering strip sections leading away from the aperture, matching the aperture source to similar or dissimilar strip port wave impedances with equal or unequal power division between the two ports.

Figure 9:
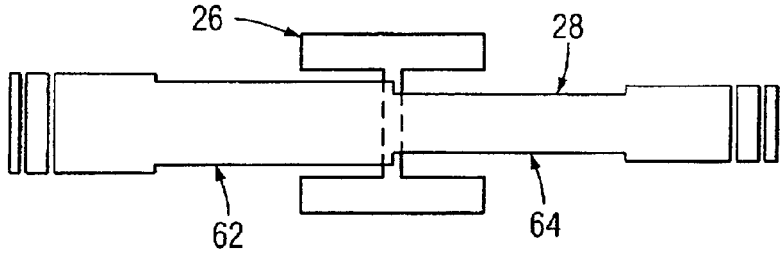
FIG. 9 is an end view of a portion of another embodiment of a waveguide to microstrip transition constructed in accordance with the invention.
Figure 10:
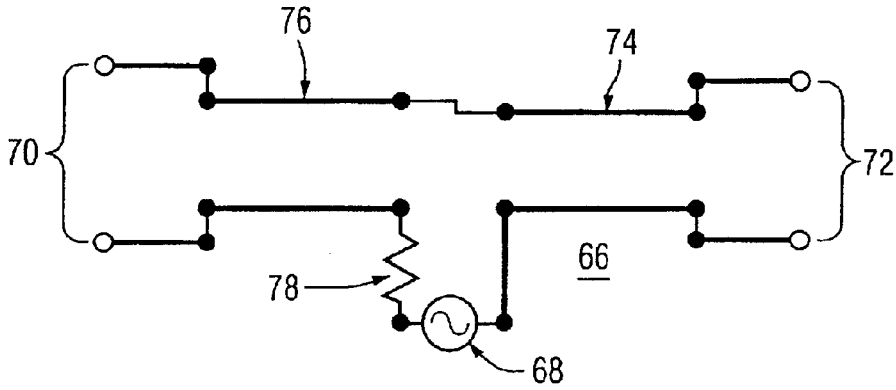
FIG. 10 is schematic diagram of an equivalent circuit for the waveguide to microstrip transition of FIG. 9.

A variation on the preferred embodiment, i.e. an asymmetric T-junction applicable as an unequal power splitter/combiner, is shown in FIG. 9. FIG. 9 is an end view of a portion of another embodiment of a waveguide to microstrip transition having a variation in the strip geometry to create an asymmetric and/or unequal power splitter/combiner in accordance with the invention. The strip conductor 28 is shown to include two portions 62 and 64 of different widths. FIG. 10 is schematic diagram 66 of an equivalent circuit for the waveguide to microstrip transition of FIG. 9.

In the power splitter mode of operation, the aperture 26 can be regarded as a source 68 with source impedance 78 in the equivalent transmission line model of the strip shown in FIG. 10. The strip ports 70 and 72 do not necessarily have the same characteristic impedance. The port impedances are transformed by quarter wave transformers 74 and 76, to pose as two dissimilar valued load impedances, which are connected in series to the source 68. The sum of these transformed port impedances is required to be the complex conjugate of the source impedance load under matching conditions. The potential imposed by the source 68 will divide unequally between the transformed port impedances, thereby creating an unequal power division.

Figure 11:
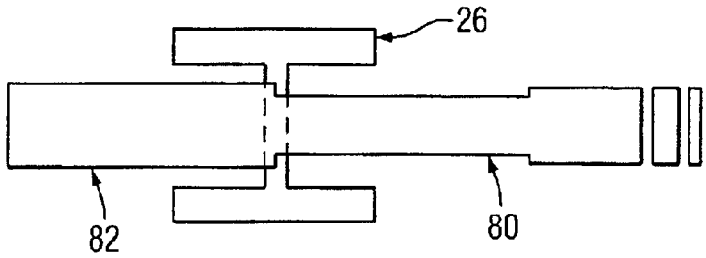
FIG. 11 is an end view of a portion of another embodiment of a waveguide to microstrip transition constructed in accordance with the invention.
Figure 12:
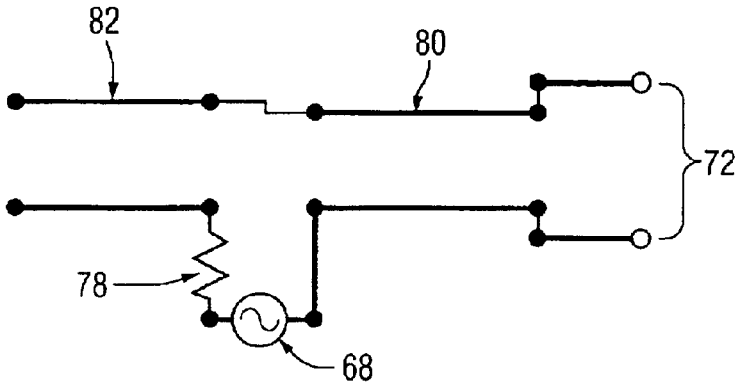
FIG. 12 is schematic diagram of an equivalent circuit for the waveguide to microstrip transition of FIG. 11.

In another embodiment, one of the strip ports can be short circuited to the ground plane close to the aperture, or left as an open circuited stub (typically a quarter wavelength long), to create a two-port device. FIG. 11 is an end view of a portion of the open circuit stub embodiment. In this embodiment, stepped or tapered sections 80 in the strip, together with the open-circuited stub 82, can be used for arbitrary broadband matching between the aperture source and the strip port. FIG. 12 is schematic diagram of an equivalent circuit for the waveguide to microstrip transition of FIG. 11. An impedance transformer 80, approximately a quarter wavelength long, is used to match the remaining microstrip port 72 to the aperture equivalent source impedance 78. The length of the open circuited stub 82, together with the length of the impedance transformer 80, are adjusted to eliminate any reactive component in the aperture equivalent source impedance 78. These adjustments, together with an arbitrary value for the characteristic impedance of the open circuited stub 82, are optimized for maximum matching bandwidth.

Figure 13:
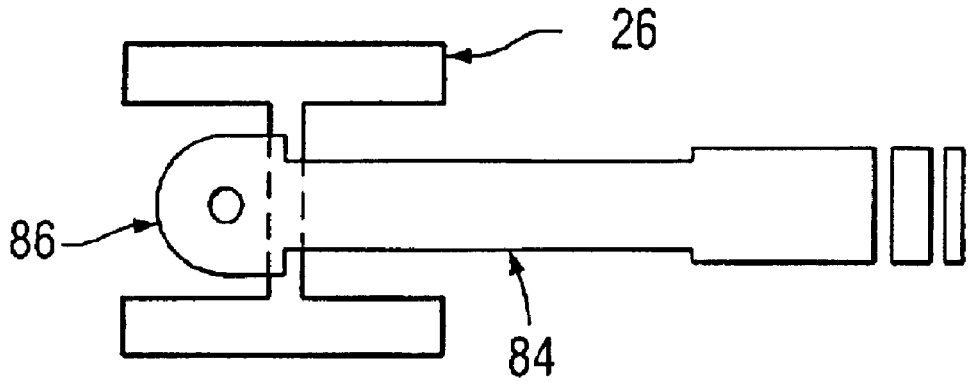
FIG. 13 is an end view of a portion of another embodiment of a waveguide to microstrip transition constructed in accordance with the invention.
Figure 14:
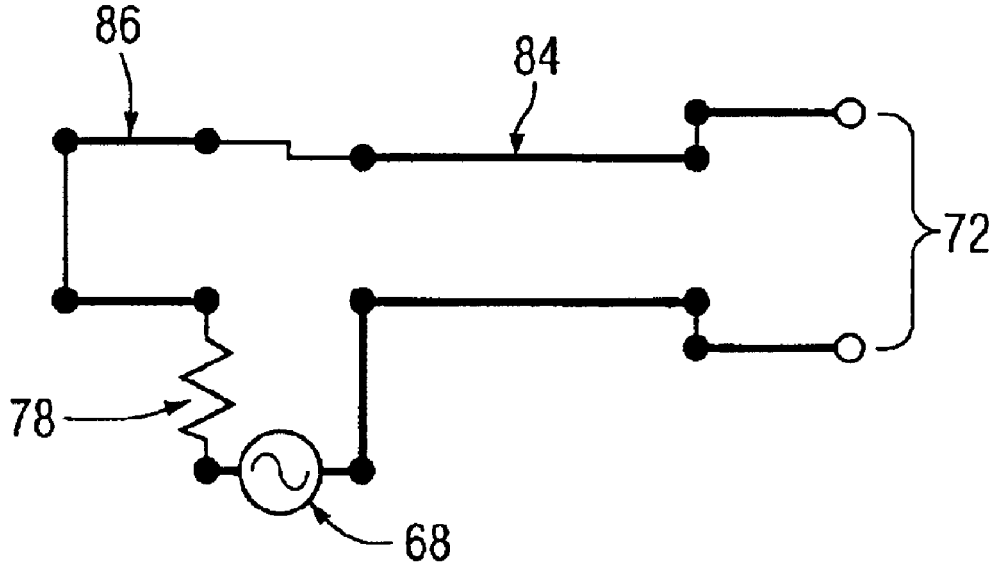
FIG. 14 is schematic diagram of an equivalent circuit for the waveguide to microstrip transition of FIG. 13.

FIG. 13 is an end view of a portion of the short-circuited embodiment. In this embodiment, stepped or tapered sections 84 in the strip, together with the short 86, can be used for arbitrary broadband matching between the aperture source and the strip port. FIG. 14 is schematic diagram of an equivalent circuit for the waveguide to microstrip transition of FIG. 13.

The short-circuited stub 86 includes a short section of microstrip terminated by a short circuit to the ground plane. An impedance transformer 84, approximately a quarter wavelength long, is used to match the remaining microstrip port 72 to the aperture equivalent source impedance 78. These adjustments, together with an arbitrary value for the characteristic impedance of the short-circuited stub 86, are optimized for maximum matching bandwidth.

Figure 15:
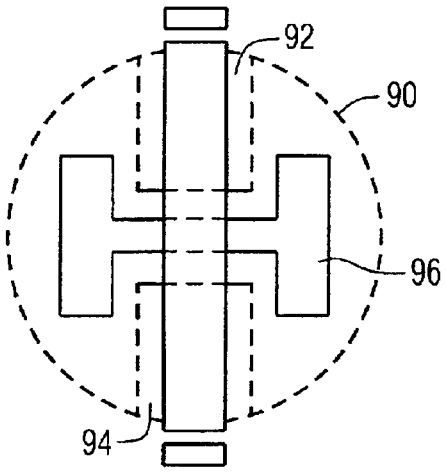
FIG. 15 is an end view of a portion of another embodiment of a waveguide to microstrip transition constructed in accordance with the invention.

FIGS. 15–18 show variations in the waveguide geometry in terms of cross-sectional shape, the aperture shape, and the number of ridges. FIG. 15 shows an elliptical/circular waveguide 90 with two ridges 92, 94 and an H-shaped aperture 96. The operation is the same as that of the rectangular waveguide described above.

Figure 16:
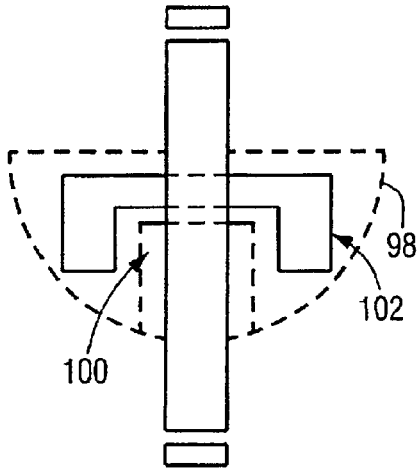
FIG. 16 is an end view of a portion of another embodiment of a waveguide to microstrip transition constructed in accordance with the invention.
Figure 17:
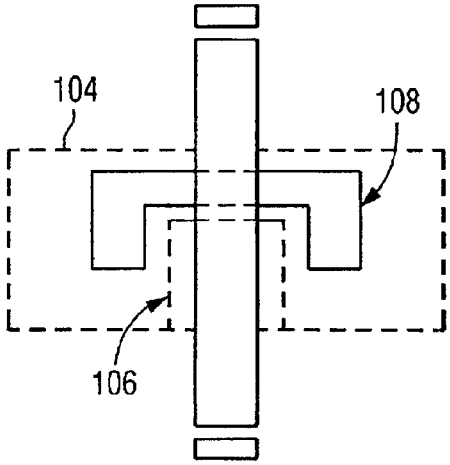
FIG. 17 is an end view of a portion of another embodiment of a waveguide to microstrip transition constructed in accordance with the invention.
Figure 18:
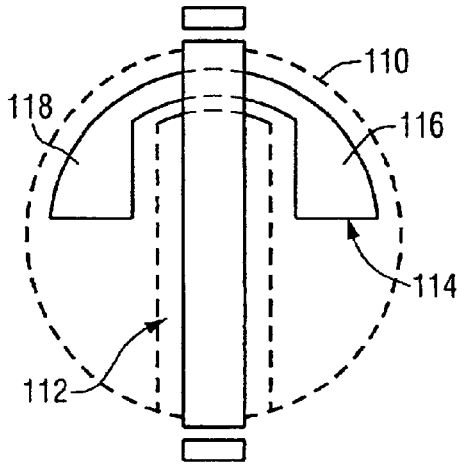
FIG. 18 is an end view of a portion of another embodiment of a waveguide to microstrip transition constructed in accordance with the invention.

FIG. 16 shows a semicircular waveguide 98 with one ridge 100 and a C-shaped aperture 102. FIG. 17 shows a rectangular waveguide 104 with one ridge 106 and a C-shaped aperture 108. FIG. 18 shows a circular waveguide 110 with one ridge 112 and a curved aperture 114 with flared ends 116, 118. In these cases, the electromagnetic energy is guided substantially in the gap formed between the single ridges and the waveguide periphery respectively, before it reaches the aperture. The surface of the ridge in the gap formed between itself and the waveguide periphery has a rounded shape to conform to the waveguide periphery.

A more specific embodiment of the ridged waveguide to microstrip T-junction geometry shown in FIG. 1 will now be described. The aperture 26 is printed as a feature in the microstrip circuit ground plane metal, which in turn is used as the end-wall 22 of the waveguide. The microstrip lines have been chosen to be 56Ω lines, imbedded 0.254 mm above the ground plane inside a 0.8 mm thick dielectric substrate (permittivity $\epsilon$=2.33). The aperture dimension along the H-plane of the waveguide was limited to 3.05 mm to keep it electrically small, therefore an H-shape was chosen to increase the effective aperture length. To allow for a possible small mechanical misalignment between the microstrip circuit and the waveguide, all the other aperture dimensions were chosen such that it may be shifted by 0.38 mm in any direction without straying over the waveguide and ridge boundaries. In a preferred embodiment of the transition of FIG. 1, a=7.11 mm; b=3.56 mm; s=0.76 mm; d=1.14 mm; w=0.533 mm; h=0.8 mm; and 1=3.05 mm. The microstrip substrate relative permittivity is 2.33.

Figure 19:
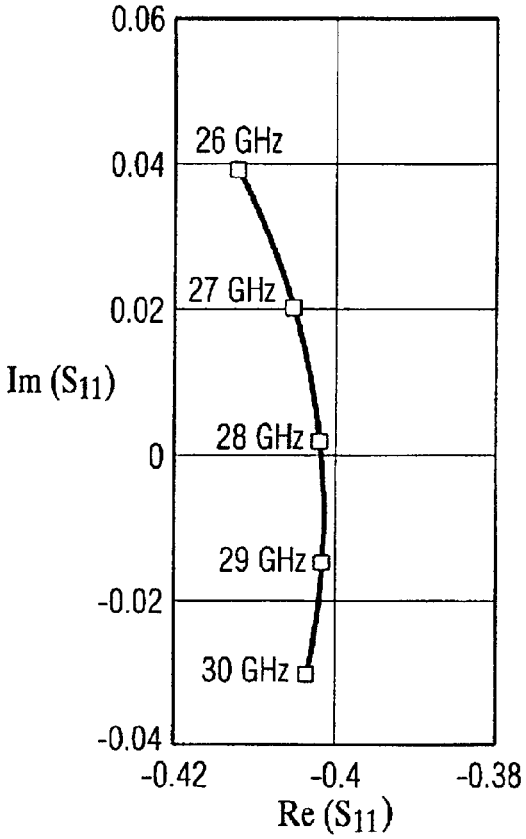
FIG. 19 is a graph of simulated results for S-parameters of a waveguide to microstrip transition constructed in accordance with the invention.
Figure 20:
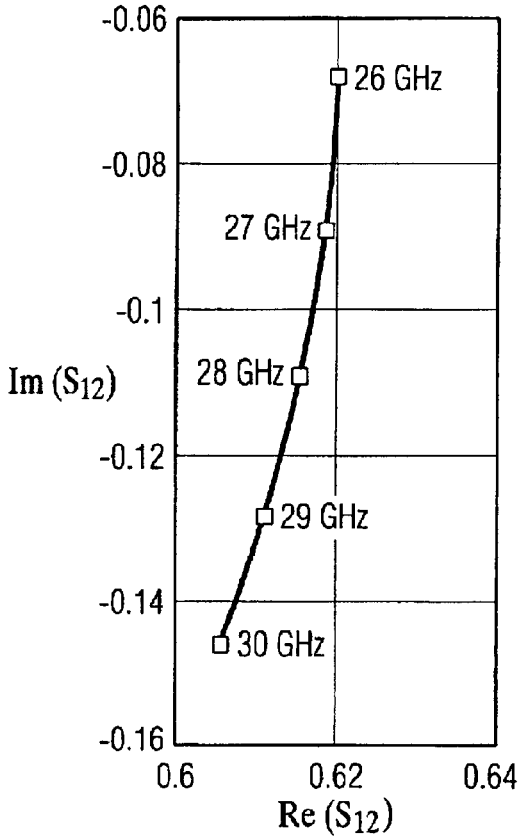
FIG. 20 is a graph of simulated results for S-parameters of a waveguide to microstrip transition constructed in accordance with the invention.

The structure was simulated using Ansoft's HFSS software, with the ridged waveguide port designated as Port 1, and the microstrip ports designated as Ports 2 and 3. The results, after de-imbedding the ridge waveguide and microstrip transmission line sections, are shown in FIGS. 19 and 20. Note that the aperture is amenable to broadband matching, since the spread of $S_{11}$ over frequency is small and >0.5.

Figure 21:
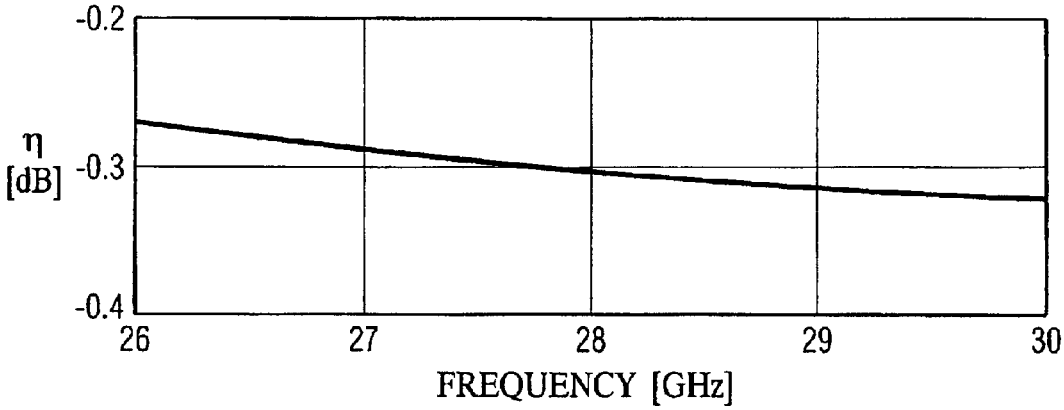
FIG. 21 is a graph of simulated efficiency of a waveguide to microstrip transition constructed in accordance with the invention.

The conductors and dielectric media in the simulation were assumed to be lossless, therefore all losses can be ascribed to radiation loss. The efficiency of the transition can be defined as $\eta=(|S_{12}|^2+|S_{12}|^2)/(1-|S_{11}|^2)$, which is shown in FIG. 21 as a function of frequency. The radiation loss is low, since the H-shaped aperture is not a very effective radiator.

An approximate equivalent model for the aperture T-junction is shown in FIG. 4, together with the best-fit parameter values. The microstrip characteristic impedance is denoted by $Z_{ms}$, the ridged waveguide wave impedance is denoted by $Z_{rwg}$, and the resistor $Z_r$ represents the radiation resistance. The short-circuited stub transmission line $TL_{slot}$ (characteristic impedance $Z_{slot}$ and the electrical length $\beta l_{slot}$) represents the aperture slot line. Transmission line $TL_t$ (characteristic impedance $Z_t$, and electrical length $\beta l_t$) represents the excess length of the T-junction. The equivalent circuit parameters for the aperture slot indicate that it is resonant at about 28 GHz. The values of the parameters for the preferred embodiment that conform to simulation results are: $Z_{ms}=56\Omega$; $Z_r\approx1540\Omega$; $Z_t\approx104.3\Omega$; $\beta l_t\approx0.058\pi f/f_c$; $\beta l_{slot}\approx0.495\pi f/f_c$; and $\eta\approx(0.426Z_{rwg}/Z_t)^{0.5}$.

For a low loss solution, impedance matching should be done in the waveguide rather than on the microstrip side, since resonant microstrip matching sections will introduce more radiation, conductor and dielectric losses. The ridge provides a convenient means of changing the waveguide wave impedance, i.e. by varying the ridge gap d and/or the widths.

Figure 23:
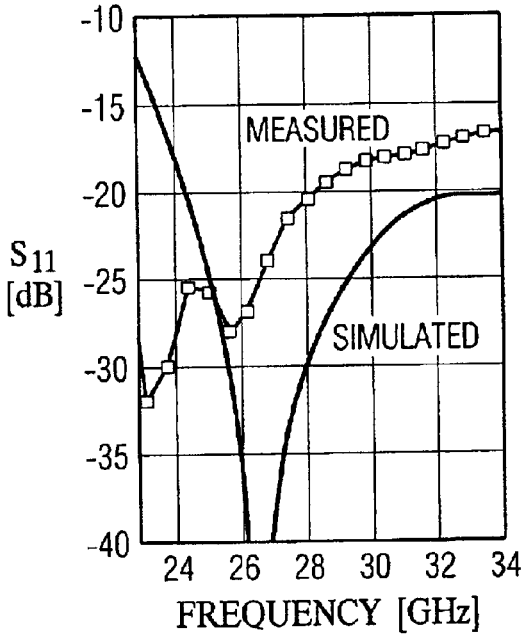
FIG. 23 is a graph of simulated and measured results for S-parameters of a waveguide to microstrip transition constructed in accordance with the invention.
Figure 24:
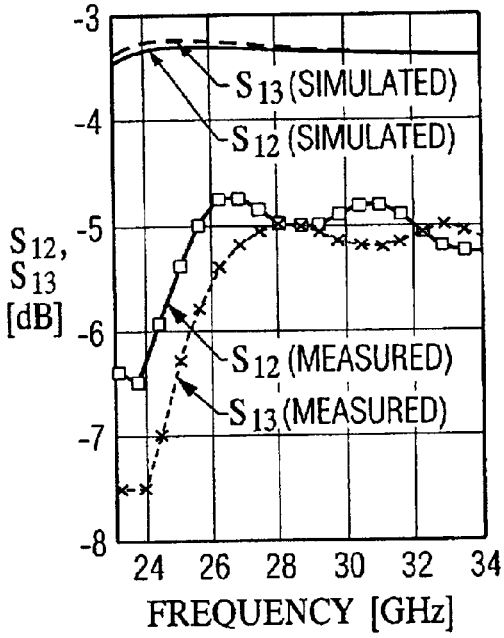
FIG. 24 is a graph of simulated and measured results for S-parameters of microstrip transition constructed in accordance with the invention.

A short section of about 1 mm of the original ridge waveguide is used as a first stage, to keep the first step in the ridge a reasonable distance away from the aperture, thereby reducing higher order mode interaction between them. From this point, numerous matching topologies are possible for achieving a wide band solution in this way. One possible geometry is shown in FIG. 5, where a second matching stage was used for eliminating most of the reactive component of the reflection coefficient, followed by a final single wave-impedance transforming stage. The second stage can be broken into two shorter sub-stages as shown, so as to reduce the step between the second and third stages. The matching section dimensions for this particular case was optimized using Ansoft's HFSS software, and the simulation results are shown in FIGS. 23 and 24. The measured $S_{12}$ and $S_{13}$ values include all transmission losses in the experimental setup, while simulated results only include radiation losses. The waveguide port is port 1, and the two microstrip ports are port 2 and 3 respectively. The measured $S_{12}$ and $S_{13}$ values include all transmission losses in the experimental setup, while the simulated results only include radiation losses. Note that $S_{12}$ and $S_{13}$ are not exactly the same, due to small numerical errors.

A brass test fixture was made to test the validity of the simulations. The stepped ridge matching stages were machined to within 0.03 mm accuracy, and the microstrip circuit was printed on a multilayer Taconic TLY-3 substrate, using ½ oz. copper and a 0.025 mm thick bonding film. A 50 mm length of microstrip line was used in the experiment, which included two ¼ wave transformers (at 28 GHz) on both sides of the aperture to match the 56Ω strips to 50Ω co-axial ports. On the waveguide side, a co-axial to waveguide adapter followed by a 52 mm uniform rectangular waveguide section to the first ridge was used. The measurement results, also shown in FIGS. 23 and 24, were obtained after the reflections from the co-axial transitions have been eliminated using time-domain gating. The insertion losses other than the radiation loss in the measurements were estimated to be about at least 1.5 dB. Therefore from FIGS. 23 and 24, the radiation loss by itself is not more than about 0.5 dB.

The tolerance problem is very important in a manufacturing process where a large number of these waveguide ends need to be aligned with an electrically large circuit board. The geometry studied here is the same as that shown in FIG. 1, with the microstrip circuit shield parallel to the either the E-plane or H-plane or at a 45° angle to these directions.

Figure 22:
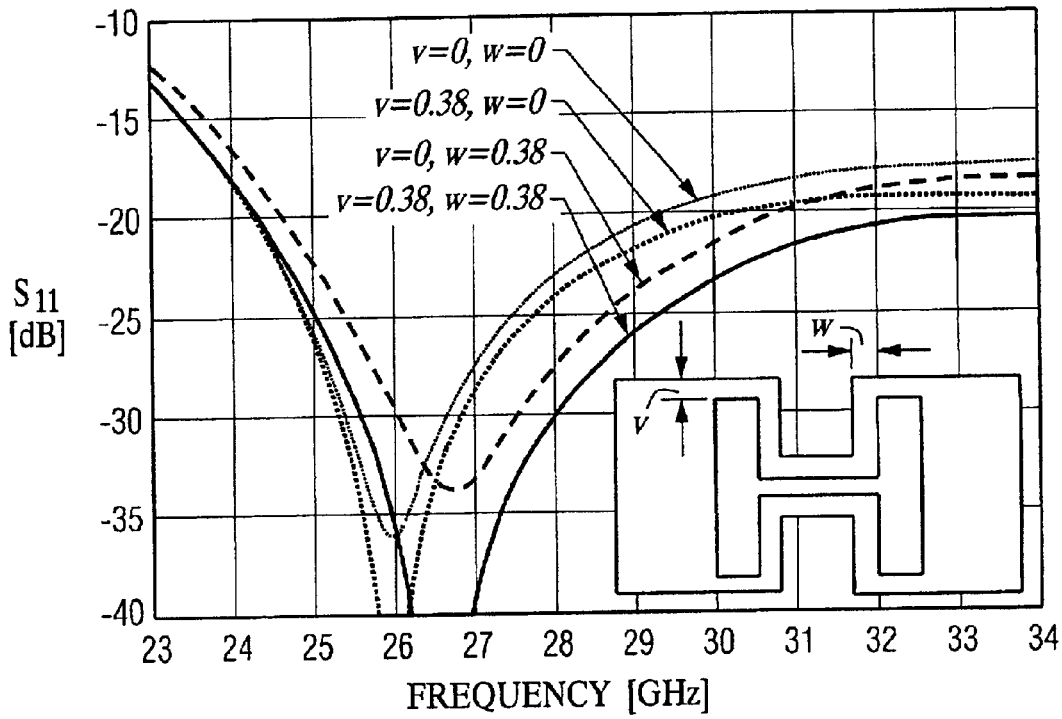
FIG. 22 is a graph of simulated results for S-parameters of a waveguide to microstrip transition constructed in accordance with FIG. 1.

Numerical simulations showed that the transmission parameters $S_{12}$ and $S_{13}$ do not change significantly. The simulated effect on the return loss for misalignment between the waveguide and the microstrip is shown in FIG. 22. The parameters v and w defined in the inset diagram, represent the position of the aperture with respect to the waveguide. Both parameters have an ideal value of 0.38 mm. Note that the 20 dB return loss bandwidth is still about 4.5 GHz, therefore the aperture coupling mechanism is fairly insensitive to these variations, which makes it a desirable design choice for manufacturability.

A new wide band H-shaped aperture coupled transition from waveguide to microstrip has been presented, featuring a ridged waveguide matching section. It is shown experimentally that the transition operates over a wide bandwidth. The aperture's position with respect to the waveguide is not very critical, which allows for a tolerance-friendly design. The symmetric T-junction can form the basis for the design of derivative geometries such as asymmetric T-junctions and waveguide to single microstrip transitions.

This invention provides a wideband waveguide to microstrip transition. The transition is achieved by way of an aperture in the end-wall of a rectangular waveguide. Wave impedance matching is done via ridges in the waveguide, which ensures a wideband, low loss transition. This type of transition is very well suited as a general-purpose microwave component in a variety of applications such as radar, microwave instrumentation, communication and measurement systems, where it will typically form part of microwave components such as antenna feed networks, filters, or diplexers. The device can be used over a wide frequency range, covering the microwave and millimeter wave ranges.

The preferred embodiments of the present invention provide an aperture coupled, microstrip to waveguide transition suitable for use in devices where the low loss properties of the waveguide are combined with the flexibility and compactness of microstrip circuits.

This invention presents a new method for achieving a wide band transition, based on a ridged waveguide approach to an electrically small aperture in the end-wall of a waveguide, with an external microstrip line aligned parallel to the end-wall, and transverse to the longer dimension of the aperture. A ridged waveguide guides the electromagnetic energy more directly to an aperture in the end-wall of the waveguide, avoiding high Q resonances that are associated with increased conduction losses. The invention also features a transition from ridged waveguide portion to a ridgeless waveguide portion in the form of smooth or stepped tapered ridge sections. Resonances created by these stepped or tapered ridge sections typically cause only low Q resonances, and as a result introduce very little extra loss. The invention also features an electrically small (substantially less than half a wavelength at the frequency of operation) aperture to minimize radiation loss.

The preferred embodiments of the invention use a ridge or ridges for matching to the aperture as in the present invention, and an electrically small aperture to reduce radiation loss. This invention achieves wide band aperture coupling, based on a ridged waveguide approach. The particular geometry described here was developed for an application at 28 GHz.

It should be appreciated that the cross-sectional shape of the waveguide, the shape of the aperture and the number of ridges can be varied to create many different embodiments, which are still based on the same basic principle of a waveguide with ridge matching sections, coupling to a strip via an aperture in the end-wall of the waveguide. While the invention has been described in terms of its preferred embodiments, those skilled in the art will recognized that various changes can be made to those embodiments without departing from the invention as defined by the following claims.

What is claimed is:

1. A waveguide to microstrip T-junction comprising:

a microstrip transmission line structure having a ground plane separated from a strip conductor by a dielectric layer, said ground plane defining an aperture;

quarter wavelength matching sections in the microstrip transmission line a waveguide channel having a conductive periphery being electrically coupled to the ground plane to provide a waveguide short circuit wall located at the end of the waveguide channel;

at least one conducting ridge inside the waveguide channel; and an end of the ridge being electrically coupled with the ground plane.

2. A waveguide to microstrip T-junction comprising:

a microstrip transmission line structure having a ground plane separated from a strip conductor by a dielectric layer, said ground plane defining an aperture;

an open circuited stub, and a quarter wavelength matching section in the microstrip transmission line;

a waveguide channel having a conductive periphery being electrically coupled to the ground plane to provide a waveguide short circuit wall located at the end of the waveguide channel;

at least one conducting ridge inside the waveguide channel; and an end of the ridge being electrically coupled with the ground plane.

3. A waveguide to microstrip T-junction comprising:

a microstrip transmission line structure having a ground plane separated from a strip conductor by a dielectric layer, said ground plane defining an aperture;

a short circuited stub using a via, and a quarter wavelength matching section in the microstrip transmission line;

a waveguide channel having a conductive periphery being electrically coupled to the ground plane to provide a waveguide short circuit wall located at the end of the waveguide channel;

at least one conducting ridge inside the waveguide channel; and an end of the ridge being electrically coupled with the ground plane.

4. A waveguide to microstrip T-junction comprising:

a microstrip transmission line structure having a ground plane separated from a strip conductor by a dielectric layer;

a waveguide channel having a conductive periphery being electrically coupled to the ground plane to provide a waveguide short circuit wall located at the end of the waveguide channel;

a single finite length, rectangular cross-sectional conducting ridge inside the waveguide channel, such that the ridge is electrically coupled to the waveguide periphery, the end of the ridge is electrically coupled with the ground plane at the end of the waveguide channel, and the ridge provides a gap between itself and the waveguide periphery; and a C-shaped aperture in the ground plane section circumscribed by the waveguide periphery and ridge coupling with the ground plane.

5. A waveguide to microstrip T-junction comprising:

a microstrip transmission line structure having a ground plane separated from a strip conductor by a dielectric layer, said ground plane defining an aperture;

a waveguide channel having a conductive periphery being electrically coupled to the ground plane to provide a waveguide short circuit wall located at the end of the waveguide channel;

at least one conducting ridge inside the waveguide channel;

an end of the ridge being electrically coupled with the ground plane; and a second ridge, wherein a projection of a gap between the ridges on the ground plane, is transverse to the microstrip line.

6. A waveguide to microstrip T-junction comprising:

a microstrip transmission line structure having a ground plane separated from a strip conductor by a dielectric layer;

a waveguide channel having a conductive periphery being electrically coupled to the ground plane to provide a waveguide short circuit wall located at the end of the waveguide channel;

a single finite length, rectangular cross-sectional conducting ridge inside the waveguide channel, such that the ridge is electrically coupled to the waveguide periphery, the end of the ridge is electrically coupled with the ground plane at the end of the waveguide channel, and the ridge provides a gap between itself and the waveguide periphery;

an aperture in the ground plane section circumscribed by the waveguide periphery and ridge coupling with the ground plane; and wherein a projection of the gap between the ridge and the waveguide periphery on the ground plane, is transverse to the microstrip transmission line.

* * * * *